US008575506B2

(12) United States Patent
Kitahara et al.

(10) Patent No.: US 8,575,506 B2
(45) Date of Patent: Nov. 5, 2013

(54) PUSH SWITCH

(75) Inventors: Takahisa Kitahara, Isesaki (JP); Toshiyuki Muto, Isesaki (JP); Kenji Mizushima, Yokohama (JP)

(73) Assignees: Tokyo Parts Industrial Co., Ltd., Isesaki-shi, Gunma (JP); Alpha Corporation, Yokohama-shi, Kanagawa (JP)

( * ) Notice: Subject to any disclaimer, the term of this patent is extended or adjusted under 35 U.S.C. 154(b) by 211 days.

(21) Appl. No.: 13/146,222

(22) PCT Filed: Feb. 2, 2010

(86) PCT No.: PCT/JP2010/051420

§ 371 (c)(1),
(2), (4) Date: Jul. 26, 2011

(87) PCT Pub. No.: WO2010/087494

PCT Pub. Date: Aug. 5, 2010

(65) Prior Publication Data

US 2011/0284352 A1 Nov. 24, 2011

(30) Foreign Application Priority Data

Feb. 2, 2009 (JP) ..... 2009-021130

(51) Int. Cl.
*H01H 3/12* (2006.01)

(52) U.S. Cl.
USPC ..... 200/341; 200/302.2

(58) Field of Classification Search
USPC ..... 200/341, 302.1–302.2, 293, 296, 345
See application file for complete search history.

(56) References Cited

U.S. PATENT DOCUMENTS

| | | | | |
|---|---|---|---|---|
| 6,626,473 | B1 * | 9/2003 | Klein et al. | 292/347 |
| 6,768,070 | B2 * | 7/2004 | Lewison et al. | 200/296 |
| 7,230,196 | B2 * | 6/2007 | Toyama | 200/314 |
| 7,764,936 | B2 * | 7/2010 | Nakasono et al. | 455/128 |
| 8,044,313 | B2 * | 10/2011 | Yamamoto | 200/314 |
| 2004/0262139 | A1 | 12/2004 | Ieda et al. | |
| 2009/0057114 | A1 | 3/2009 | Yamamoto | |

FOREIGN PATENT DOCUMENTS

| | | |
|---|---|---|
| JP | 3-99586 | 10/1991 |
| JP | 11-288635 | 10/1999 |
| JP | 2003-257274 | 9/2003 |
| JP | 2004-327126 | 11/2004 |
| JP | 2007-207473 | 8/2007 |
| JP | 2009-54430 | 3/2009 |

* cited by examiner

*Primary Examiner* — Xuong Chung Trans
(74) *Attorney, Agent, or Firm* — Drinker Biddle & Reath LLP

(57) ABSTRACT

A push switch is provided with a button (10), a switch board (20), a switch (30) provided on the switch board (20), and a switch cover (40) disposed in the button (10) and covering the switch (30). A corner portion (44) between a side wall (43) and a upper wall (42) of the switch cover (40) is formed in a curved shape. A protruding pressing portion (13) of the button (10) is inserted into a through hole (41) provided on an upper wall (42) of the switch cover (40). A lower surface of the pressing portion (13) faces an operating portion (31) of the switch (30).

5 Claims, 4 Drawing Sheets

PUSH SWITCH

TECHNICAL FIELD

The present invention relates to a push switch.

BACKGROUND ART

As conventional push switches, there is, for example, a water resistant push switch provided on a door handle (JP-A-2004-327126). The push switch is attached into an outside handle 103 of a door lock device of a vehicle and is pressed when a user is to operate a door lock to lock or unlock a door of the vehicle.

A button 171 of the push switch is constituted by a rubber material and is formed by an operating portion 128 fitted into a handle cover 104, a thin portion 121, and a boss portion 166 protruded toward a switch 107 side below the operating portion 128.

The door switch 107 pressed against the boss portion 166 is covered with a switch cap 168 in order to ensure a water resistance and a moisture resistance. The switch cap 168 is fitted into a peripheral edge of an opening of a switch case 176 fixed to the outside handle 103, and a switch plate 177 is further fitted into the switch case 176.

When the push switch is pressed by the user, the thin portion 121 of the button 171 is deformed so that the boss portion 166 presses the switch cap 168 provided therebelow. A pressing portion 179 of the switch 107 having a water resistant structure which is provided below the switch cap 168 is pressed by the pressing force. Thus, the switch 107 is turned ON.

In that case, if an excessively great load is input as an external force to the button 171, the thin portion 121 of the button 171 is deformed and moved toward the switch side up to a position in which an end face 122 on an inside of the button 171 abuts on an end face 123 of the switch plate 177.

In the push switch, when the button 171 is pressed at an excessively great load in a vertical direction of the drawing, the end face 122 of the operating portion 128 abuts on the end face 123 of the switch plate 177 so that the pressing load acts toward a peripheral edge portion of the switch cap 168 and is transmitted to a lower part of the switch case 176, and is moved away toward a load receiving portion 126 of a body portion 132 abutting on the switch case 176. For this reason, it is assumed that the excessively great load can be prevented from acting on the pressing portion 179 of the switch 107.

However, the push switch is not always pressed only in the vertical direction of the drawing but might be pressed in every direction. For example, in the case in which the button 171 is pressed at an excessively great load in an obliquely transverse direction of the drawing, the thin portion 121 of the button 171 is extended unnecessarily or the thin portion 121 of the button 171 or the boss portion 166 collides with a corner part of an opening portion of the switch plate 177. When the pressing operation in the obliquely transverse direction of the drawing is repeated, there is a possibility that the thin portion 121 of the button 171 or the boss portion 166 might be cracked and broken.

SUMMARY OF INVENTION

Embodiments of the invention provide a push switch having a high reliability which can prevent a breakage of a soft button and can inhibit an excessively great load from being applied to a switch even if a pressing force is applied in every direction.

In accordance with one or more embodiments of the invention, a push switch is provided with a soft button 10 having a side peripheral wall 12 and an upper operating wall 11, and an opening portion 14 on a lower surface; a switch board 20 attached to the opening portion 14 of the button 10; a switch 30 provided on the switch board 20; a case 50 fixed to the side peripheral wall 12 of the button 10; and a hard switch cover 40 disposed on an inside of the button 10 for covering the switch 30. The switch cover 40 has a side wall 43, an upper wall 42, and a corner portion 44 formed like a curved surface between the side wall 43 and the upper wall 42. A pressing portion 13 protruded into an inner part from the upper operating wall 11 of the button 10 is inserted into a through hole 41 provided on the upper wall 42 of the switch cover 40, and a lower surface of the pressing portion 13 faces an operating portion 31 of the switch 30.

According to the structure, the hard switch cover 40 is disposed with a space provided on an inside of the soft button 10 in order to cover the switch 30, and the corner portion 44 provided between the side wall 43 and the upper wall 42 in the switch cover 40 is formed like the curved surface. For this reason, also in the case in which an excessively great load is applied as an external force in an optional direction to the button 10, an inside of the button 10 abuts on a flat or curved surface-shaped portion of the switch cover 40. Consequently, it is possible to prevent the soft button 10 from being broken without damaging the inside of the button 10. Furthermore, a stroke amount of the button 10 is controlled reliably by the switch cover 40. Therefore, it is possible to prevent an excessively great load from being applied to the switch 30. As a result, a push switch having a high reliability is provided.

A distance A between a lower surface of the upper operating wall 11 of the button 10 and an upper surface of the upper wall 42 of the switch cover 40 may be substantially equal to a distance of a stroke from a pressing operation of the button 10 to an ON operation of the switch 30.

In addition, a distance B in a transverse direction between the pressing portion 13 of the button 10 and a peripheral wall of the through hole 41 of the switch cover 40 may be set to be greater than a distance C in the transverse direction between the side peripheral wall 12 of the button 10 and the side wall 43 of the switch cover 40.

Other aspects and advantages of the invention will be apparent from the following description and the appended claims.

BRIEF DESCRIPTION OF DRAWINGS

FIG. 1(*b*) is a sectional view taken along F-F in FIG. 1(*a*).

MODE FOR CARRYING OUT THE INVENTION

Modes for carrying out the invention will be illustratively described as exemplary embodiments with reference to the drawings. The scope of the invention should not be construed to be restricted to only materials, shapes and relative arrangements of components described in the embodiments unless there are any specific descriptions.

First Exemplary Embodiment

Figure 1A:
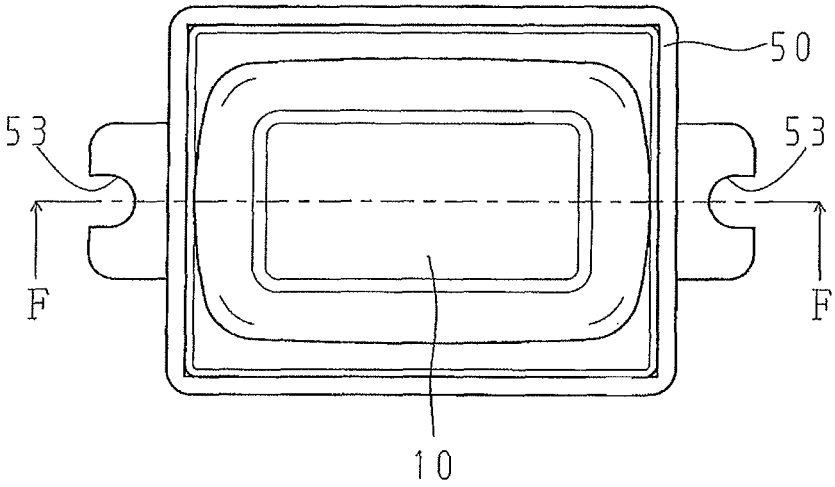
FIG. 1(*a*) is a plan view showing a push switch according to a first exemplary embodiment.
Figure 1B:
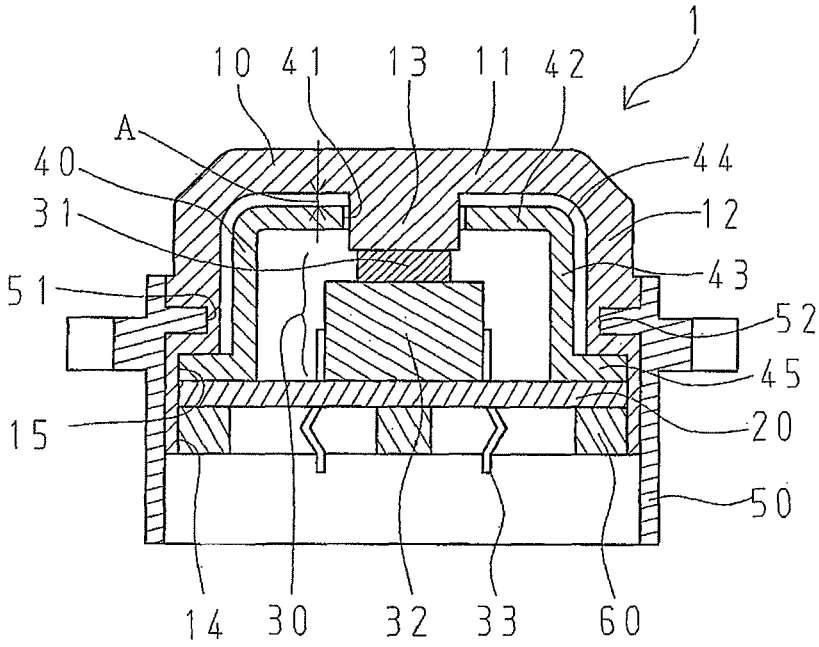
Figure 2:
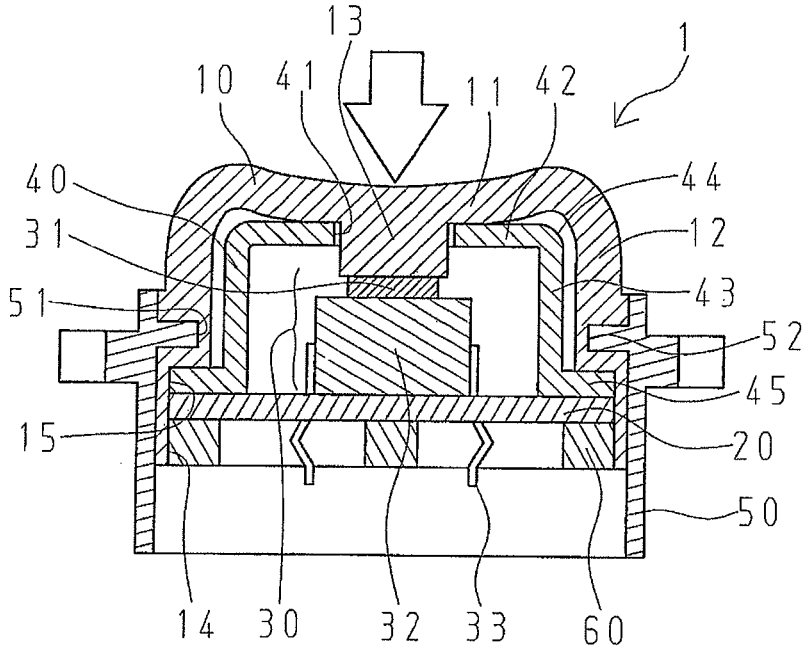
FIG. 2 is a sectional view showing a first operation of the push switch in FIG. 1.
Figure 3:
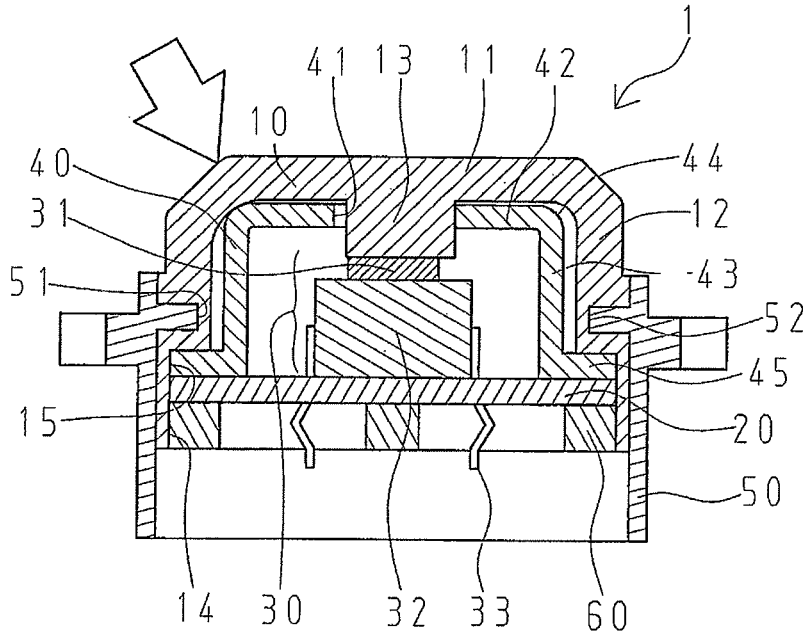
FIG. 3 is a sectional view showing a second operation of the push switch in FIG. 1.

FIG. 1(*a*) is a plan view showing a push switch according to a first exemplary embodiment of the invention and FIG. 1(*b*) is a sectional view taken along F-F in FIG. 1(*a*). FIG. 2 is a sectional view showing a first operation of the push switch in FIG. 1. FIG. 3 is a sectional view showing a second operation of the push switch in FIG. 1.

In FIGS. 1 to 3, a push switch 1 according to the exemplary embodiment is attached to a door handle device for a vehicle which is not shown. When operating a door lock device, a user can lock or unlock a door by pressing a button 10 of the push switch 1 exposed from the door handle device for a vehicle with a finger.

The push switch 1 has the button 10, a switch board 20, a switch 30, a switch cover 40, a case 50 and a stopper 60.

The button 10 is formed in an substantially equal thickness by a soft resin having an elasticity, for example, a rubber, and includes an upper operating wall 11 taking an substantially square shape, a side peripheral wall 12 erected on a periphery thereof, and an substantially cylindrical pressing portion 13 protruded integrally from an inner part at an substantially center of the upper operating wall 11 and has an opening portion 14 on a lower surface. The pressing portion 13 is disposed in a movable state (a vertical direction of the drawing) in a through hole 41 provided on the switch cover 40 which will be described below.

A step portion 15 is formed on an inside of the side peripheral wall 12 in the button 10, and the insulating switch board 20 for hermetically sealing an inner part of the button 10 is attached to the step portion 15.

In the button 10, the switch 30 is disposed on the switch board 20. The switch 30 has an operating portion 31 and a body portion 32. The operating portion 31 is protruded from an inner part of the body portion 32 and is constituted movably in the vertical direction of the drawing, and is supported upward in the drawing by means of an elastic member in the body portion 32 which is not shown. When the operating portion 31 is pressed, the switch 30 is turned ON so that a signal is transmitted to an outside through a connecting terminal 33 fixed to the switch board 20 by means of a lead wire which is not shown.

The switch cover 40 is formed by a hard resin, and has a rigidity and is disposed with a space provided with respect to an inside of the button 10 in order to cover the switch 30. The switch cover 40 has an upper wall 42 taking an substantially square shape, a side wall 43 erected on a periphery thereof, a curved surface portion 44 in which corner portions of the upper wall 42 and the side wall 43 are formed like a curved surface and which takes an outward convex shape, a peripheral edge portion 45 protruded outward from an end of the side wall 43, and the through hole 41 on an substantially center of the upper wall 42 through which the pressing portion 13 of the button 10 is movable. Ina state in which the pressing portion 13 of the button 10 is inserted in the through hole 41, the pressing portion 13 and the operating portion 31 of the switch 30 are disposed to be close to each other in a facing condition or to abut on each other.

In the case in which the corner portion 44 has an arcuate section, it is preferable that a radius of curvature R of the circular arc should be equal to or greater than a double of a distance A between a lower surface of the upper operating wall 11 in the button 10 and an upper surface of the upper wall 42 in the switch cover 40 ($R \geq 2A$). The sectional shape of the corner portion 44 does not need to take an arcuate shape which is completely round. For example, it is possible to obtain equivalent advantages even if a chamfering shape is taken. In other words, the chamfered corner portion is also included in the corner portion formed to take a shape of the curved surface. Referring to a chamfering size, it is preferable that a chamfering width should be equal to or greater than the distance A between the lower surface of the upper operating wall 11 in the button 10 and the upper surface of the upper wall 42 in the switch cover 40 in the case of 45-degree chamfering, for example.

The switch cover 40 has the peripheral edge portion 45 interposed between the step portion 15 of the button 10 and the switch board 20, and is fixed into the button 10.

A space is provided between the outside of the switch cover 40 and the inside of the button 10. Even if the hard switch cover 40 is provided in the soft button 10, therefore, the button 10 is pressed with an elastic deformation (states in FIGS. 2 and 3) so that the pressing force can turn ON the switch 30 through the pressing portion 13 when the button 10 is pressed from the outside.

When the pressing force of the button 10 from the outside is eliminated, moreover, the button 10 itself is elastically restored so that the button 10 and the operating portion 31 are returned to initial positions (a state in FIG. 1(*b*)) and the switch 30 is thus turned OFF. Subsequently, a repeating operation can be carried out.

The case 50 is molded by a resin material and a protruded portion 51 protruded inward is engaged with a groove portion 52 provided on the side peripheral wall 12 of the button 10. Thus, rain is prevented from entering the inner part of the button 10 from the outside.

The stopper 60 is press fitted and attached into the button 10 from a lower surface of the switch board 20. After the attachment of the stopper 60, a sealing agent may be applied from a lower surface of the stopper 60 to enhance a water resistance.

An attaching hole 53 in an attachment to a door handle is provided on the outside of the case 50. The push switch 1 is attached to the door handle while the upper operating wall 11 of the button 10 is exposed through the attaching hole 53, and the upper operating wall 11 can be pressed with a finger.

Referring to the push switch 1 according to the example which has the structure, when the button 10 is pressed in a downward direction of the drawing, the button 10 itself is elastically deformed as shown in FIG. 2, and furthermore, the pressing portion 13 of the button 10 is moved in the through hole 41 of the switch cover 40 to push the operating portion 31 downward, thereby turning ON the switch 30.

At this time, also in the case in which an excessively great load is input as an external force to the button 10, an inside of the upper operating wall 11 in the button 10 abuts on the flat upper wall 42 of the hard switch cover 40. Consequently, it is possible to prevent a breakage of the soft button 10 without damaging the inside of the button 10. In addition, a stroke amount of the button 10 is controlled by the switch cover 40. Therefore, it is possible to prevent the excessively great load from being applied to the switch 30.

On the other hand, also in the case in which a pressing force is applied to the button 10 in an obliquely downward direction, the button 10 itself is elastically deformed as shown in FIG. 3, and furthermore, the pressing portion 13 of the button 10 is moved in the through hole 41 of the switch cover 40 to push the operating portion 31 downward so that the switch 30 is turned ON.

At this time, also in the case in which an excessively great load is input as an external force to the button 10, the insides of the upper operating wall 11 and the side peripheral wall 12 in the button 10 abut on the flat surfaces of the upper wall 42 and the side wall 43 or the curved surface portion 44 in the hard switch cover 40. Consequently, it is possible to prevent the breakage of the soft button 10 without damaging the inside of the button 10. Furthermore, the stroke amount of the button 10 is controlled by the switch cover 40. Therefore, it is possible to prevent the excessively great load from being applied to the switch 30.

Moreover, the through hole 41 is provided on substantially the center of the switch cover 40 and the pressing portion 13 of the button 10 is inserted into the through hole 41 to press the switch 30. Therefore, it is possible to enhance an operation feeling in the pressing direction of the switch 30 (the vertical direction of the drawing).

In addition, the peripheral edge portion 45 of the switch cover 40 is interposed between the step portion 15 of the button 10 and the board 20 and is thus fixed into the button 10. Therefore, it is possible to fix the switch cover 40 with a simple structure.

In the push switch 1 according to the exemplary embodiment, moreover, the distance A between the upper operating wall 11 of the button 10 and the upper wall 42 of the switch cover 40 is set to be substantially equal to the distance of the stroke from the pressing operation of the button 10 to the ON operation of the switch 30. For this reason, at substantially the same time that the button 10 is pressed to turn ON the switch 30, the inside of the button 10 abuts on the switch cover 40. Consequently, it is possible to reliably protect the switch without applying an unnecessarily great load to the switch 30. In addition, the hard switch cover 40 serves as a stopper for suppressing the deformation of the button 10. Thus, it is possible to prevent the breakage of the soft button 10 due to an excessive deformation more reliably, thereby enhancing a durability.

Second Exemplary Embodiment

Figure 4:
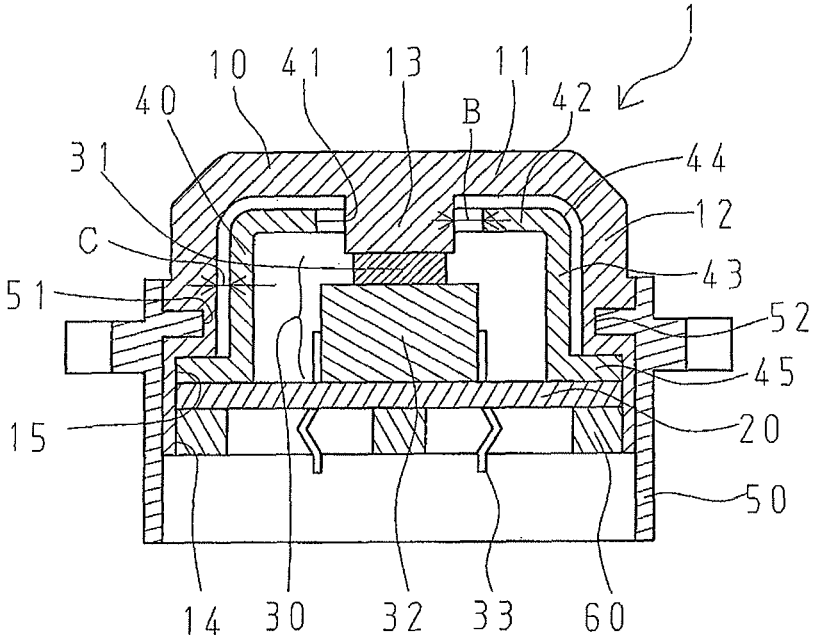
FIG. 4 is a sectional view showing a push switch according to a second exemplary embodiment.

FIG. 4 is a sectional view showing a push switch according to a second exemplary embodiment.

In FIG. 4, the same components as those in the first exemplary embodiment have the same reference numerals and repetitive description will be omitted.

The exemplary embodiment is different from the first exemplary embodiment in the following respect. Although a pressing portion 13 is disposed in a movable state in a through hole 41, there is set a through hole diameter in which the pressing portion 13 does not come in contact with a peripheral wall of the through hole 41 even if a pressing force is applied to a button 10 in an obliquely transverse direction.

More specifically, the push switch according to the exemplary embodiment has a structure in which a distance B in a transverse direction between the pressing portion 13 of the button 10 and the peripheral wall of the through hole 41 in a switch cover 40 is set to be greater than a distance C in the transverse direction between a side peripheral wall 12 of the button 10 and a side wall 43 of the switch cover 40.

Therefore, the push switch according to the exemplary embodiment can obtain the same advantages as those in the first exemplary embodiment. In addition, even if a pressing operation is repeated in an obliquely transverse direction, the pressing portion 13 does not collide with the peripheral wall of the through hole 41 in the switch cover 40 but it is possible to prevent a wear from being caused by a sliding operation of the pressing portion 13 with respect to the switch cover 40. Thus, a durability of the button 10 can further be enhanced, and furthermore, a vibration or a noise can also be prevented from being caused by the sliding operation.

Third Exemplary Embodiment

Figure 5:
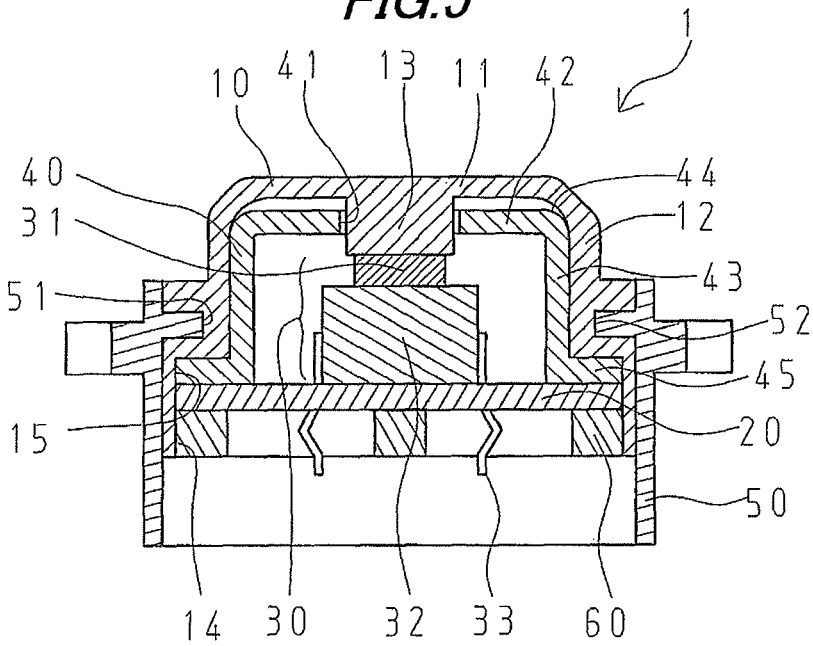
FIG. 5 is a sectional view showing a push switch according to a third exemplary embodiment.
Figure 6:
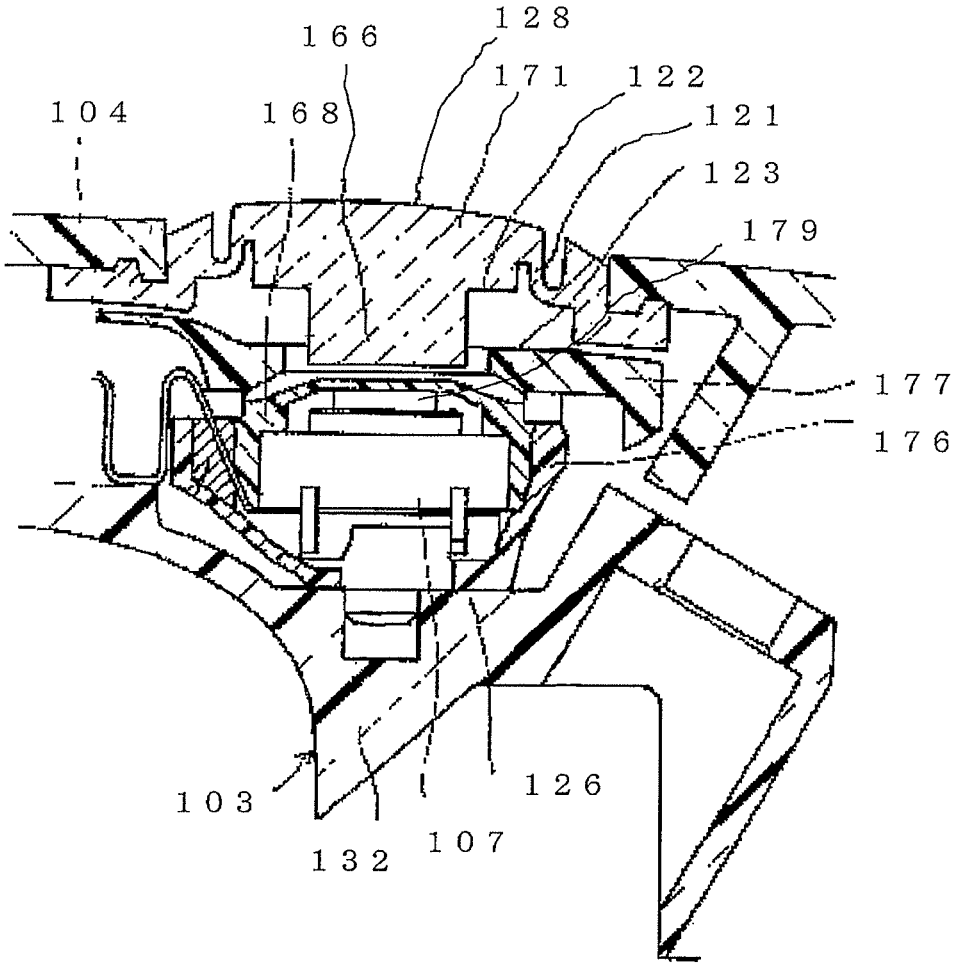
FIG. 6 is a sectional view showing a conventional push switch.

FIG. 5 is a sectional view showing a push switch according to a third exemplary embodiment.

In FIG. 5, the same components as those in the first exemplary embodiment have the same reference numerals and repetitive description will be omitted.

The exemplary embodiment is different from the first exemplary embodiment in the following respect. Although a hard switch cover 40 is disposed with a space provided with respect to an inside of a button 10 in order to cover a switch, an inside of a side peripheral wall 12 in the button 10 is disposed in contact without a space provided on a side wall 43 of the switch cover 40.

In the push switch according to the exemplary embodiment, therefore, it is possible to obtain the same advantages as those in the first exemplary embodiment, and furthermore, it is possible to suppress a deformation of the button 10 as greatly as possible, thereby preventing a breakage of the button 10 to reduce a size of the push switch even if an upper operating wall 11 or the side peripheral wall 12 in the button 10 is thinned to enhance an operability.

Although the invention has been described with reference to the specific exemplary embodiments, it is apparent to the skilled in the art that various changes and modifications can be made without departing from the spirit and scope of the invention.

INDUSTRIAL APPLICABILITY

The invention can be utilized for a push switch.

DESCRIPTION OF THE REFERENCE NUMERALS AND SIGNS

1 push switch
10 button
11 upper operating wall
12 side peripheral wall
13 pressing portion
15 step portion
20 switch board
30 switch
31 operating portion
32 body portion
33 connecting terminal
40 switch cover
41 through hole
42 upper wall
43 side wall
44 curved surface portion
45 peripheral edge portion
50 case
51 protruded portion
52 groove portion
53 attaching hole
60 stopper
103 outside handle
104 handle cover
107 switch
121 thin portion
128 operating portion
122 end face

123 end face
166 boss portion
168 switch cap
171 button
176 switch case
177 switch plate

The invention claimed is:

1. A push switch comprising:

a soft button having a side peripheral wall, an upper operating wall, and an opening portion on a lower surface;

a switch board attached to the opening portion of the button;

a switch provided on the switch board;

a case fixed to the side peripheral wall of the button; and a hard switch cover disposed in the button and covering the switch, wherein the switch cover has a side wall, an upper wall, and a corner portion formed in a curved shape between the side wall and the upper wall, wherein a pressing portion protruded inward from the upper operating wall of the button is inserted into a through hole provided on the upper wall of the switch cover, and a lower surface of the pressing portion faces an operating portion of the switch, and wherein a distance in a transverse direction between the pressing portion of the button and a peripheral wall of the through hole of the switch cover is greater than a distance in the transverse direction between the side peripheral wall of the button and the side wall of the switch cover.

2. The push switch according to claim 1, wherein a distance between a lower surface of the upper operating wall of the button and an upper surface of the upper wall of the switch cover is substantially equal to a distance of a stroke for pressing the button so as to turn ON the switch.

3. The push switch according to claim 1, wherein a step portion is formed on an inside of the side peripheral wall of the button, wherein the switch cover has a peripheral edge portion protruded outward from the side wall, and wherein the peripheral edge portion of the switch cover is interposed between the step portion of the button and the switch board.

4. A push switch comprising;

a soft button having a side peripheral wall, an upper operating wall, and an opening portion on a lower surface;

a switch board attached to the opening portion of the button;

a switch provided on the switch board;

a case fixed to the side peripheral wall of the button; and a hard switch cover disposed in the button and covering the switch, wherein the switch cover has a side wall, an upper wall, and a corner portion formed in a curved shape between the side wall and the upper wall, wherein a pressing portion protruded inward from the upper operating wall of the button is inserted into a through hole provided on the upper wall of the switch cover, and a lower surface of the pressing portion faces an operating portion of the switch, wherein a step portion is formed on an inside of the side peripheral wall of the button, wherein the switch cover has a peripheral edge portion protruded outward from the side wall, and wherein the peripheral edge portion of the switch cover is interposed between the step portion of the button and the switch board.

5. The push switch according to claim 4, wherein a distance in a transverse direction between the pressing portion of the button and a peripheral wall of the through hole of the switch cover is greater than a distance in the transverse direction between the side peripheral wall of the button and the side wall of the switch cover.

* * * * *